US005927521A

United States Patent [19]

Downes et al.

[11] Patent Number: 5,927,521

[45] Date of Patent: Jul. 27, 1999

[54] LIGHTWEIGHT AND TOPLESS DRAFT ARM

[75] Inventors: John R. Downes, Columbus; Kenneth W. Trainer, Reynoldsburg, both of Ohio

[73] Assignee: Buckeye Steel Castings Co., Columbus, Ohio

[21] Appl. No.: 08/942,468

[22] Filed: Oct. 2, 1997

[51] Int. Cl.[6] ..... B61G 9/00

[52] U.S. Cl. ..... 213/62 R; 213/66; 213/69

[58] Field of Search ..... 213/62 A, 62 R, 213/66, 69, 51, 61

[56] References Cited

U.S. PATENT DOCUMENTS

| | | | |
|---|---|---|---|
| 779,038 | 1/1905 | Guinn | 213/66 |
| 929,245 | 7/1909 | Pulliam | 213/51 |
| 929,246 | 7/1909 | Pulliam | 213/51 |
| 970,128 | 9/1910 | Shallenberger | 213/51 |
| 1,074,709 | 10/1913 | Gaines | 213/51 |
| 3,561,370 | 2/1971 | Reynolds . | |
| 3,703,239 | 11/1972 | Furniss . | |
| 4,029,022 | 6/1977 | McClurg . | |
| 4,042,117 | 8/1977 | McClurg . | |
| 4,128,062 | 12/1978 | Roberts . | |
| 4,252,068 | 2/1981 | Nolan | 213/51 |

*Primary Examiner*—Matthew C. Graham
*Assistant Examiner*—Robert J. McCarry, Jr.
*Attorney, Agent, or Firm*—Banner & Witcoff, Ltd

[57] ABSTRACT

A lightweight and topless draft arm is disclosed for use in a railway car. The draft arm includes an open top surface with the metal layer removed, lateral support members and tie-bars transversing the side walls for greater draft arm strength, and thinner side walls below the keyslots. Removal of the top surface of the draft arm eliminates the traditional double layer of material formed by the bottom of the car body and the top of the draft arm. Effectively, the bottom of the car body becomes the top of the draft arm resulting in a lighter weight railway car.

7 Claims, 3 Drawing Sheets

LIGHTWEIGHT AND TOPLESS DRAFT ARM

BACKGROUND OF THE INVENTION

1. Field of the Invention

The present invention relates in general to improved draft arms for railway cars. More specifically, but without restriction to the particular use which is shown and described, this invention relates to a lighter weight draft arm.

2. Description of the Related Art

A railcar draft arm is a box-shaped member positioned between the center sill and the coupler of a railcar. A draft arm is located on each end of the center sill, which extends along the length of the railcar body, as part of the under frame; thus two draft arms are used with each railcar. The draft arms, as with the center sill, are welded to the under frame of the railcar body. The draft arms serve the multipurpose of connecting the center sill to the railcar couplers and transmitting the draft and buff (longitudinal) loads through the railcar to the next railcar. In addition, the draft arm provides the connection between the railcar body and the trucks, which support the railcar body at both ends of the railcar.

At each end of the center sill, the draft arm is fitted and welded at its inboard end to the center sill. The outboard end of the draft arm has either a cast integral striker or a separate striker assembly that is fitted with and welded to the draft arm. A coupler assembly and its associated yoke are mounted to the outboard end of the draft arm, through the opening formed by the striker. The coupler assembly and yoke are secured to the draft arm by a draft key, which extends through a pair of aligned draft arm key slots, the striker key apertures and cooperating apertures in the coupler and yoke.

In addition to the pair of aligned draft key slots which are located in each of the side walls of the draft arm, the draft arm also includes front and rear draft lugs within the draft arm, a center plate, and a single hollow kingpin hole for receiving a kingpin or bolt extending from a railway car truck. The center plate provides the connection to the center bowl on the truck bolster.

Conventionally, draft arms are manufactured of cast steel. The draft arms therefore contribute a substantial part of the total weight of the railway car. Since there are weight limits placed on shippers of goods for preserving the safety and conditions of the track, the quantity of goods that may be placed in or on a railcar is affected by the weight of the railcar body, the trucks and other railcar components. Thus, a reduction in the weight of the railway cars, including the draft arms, will result in an increase in the total capacity of goods shipped by a rail line owner. Therefore, it is highly desirable to reduce the weight in the draft arms without a decrease in strength.

SUMMARY OF THE INVENTION

Accordingly, an object of the present invention is to reduce the weight of a railway car by reducing the overall weight of the draft arms. It is another object of this invention to reduce the weight of the draft arm without a decrease in strength. Yet another object of this invention is the elimination of the double layer of material between the bottom of the railway car body and the top of the draft arm.

Briefly stated, the present invention involves removing metal along the top surface of the draft arm, extending cross ribs or support members to the top of the draft arm for greater strength, thinning the side walls below the keyslot, and locating over the rear draft lugs stabilizing tiebars that transverse the side walls. Furthermore, at the relief area of the flange where the body bolster is attached, the flange is thicker to reduce stress.

Removal of the top surface of the draft arm eliminates the traditional double layer of material formed by the bottom of the car body and the top of the draft arm. Effectively, the bottom of the car body becomes the top of the draft arm resulting in a lighter weight railcar.

The full range of objects, aspects and advantages of the invention are only appreciated by a full reading of this specification and a full understanding of the invention. Therefore, to complete this specification, a detailed description of the invention and the preferred embodiment follows, after a brief description of the drawing.

BRIEF DESCRIPTION OF THE DRAWING

The preferred embodiment of the invention will be described in relation to the accompanying drawing. In the drawing, the following figures have the following general nature.

In the accompanying drawing, like reference numerals are used throughout the various figures for identical structures.

DESCRIPTION OF THE PREFERRED EMBODIMENTS

Figure 1:
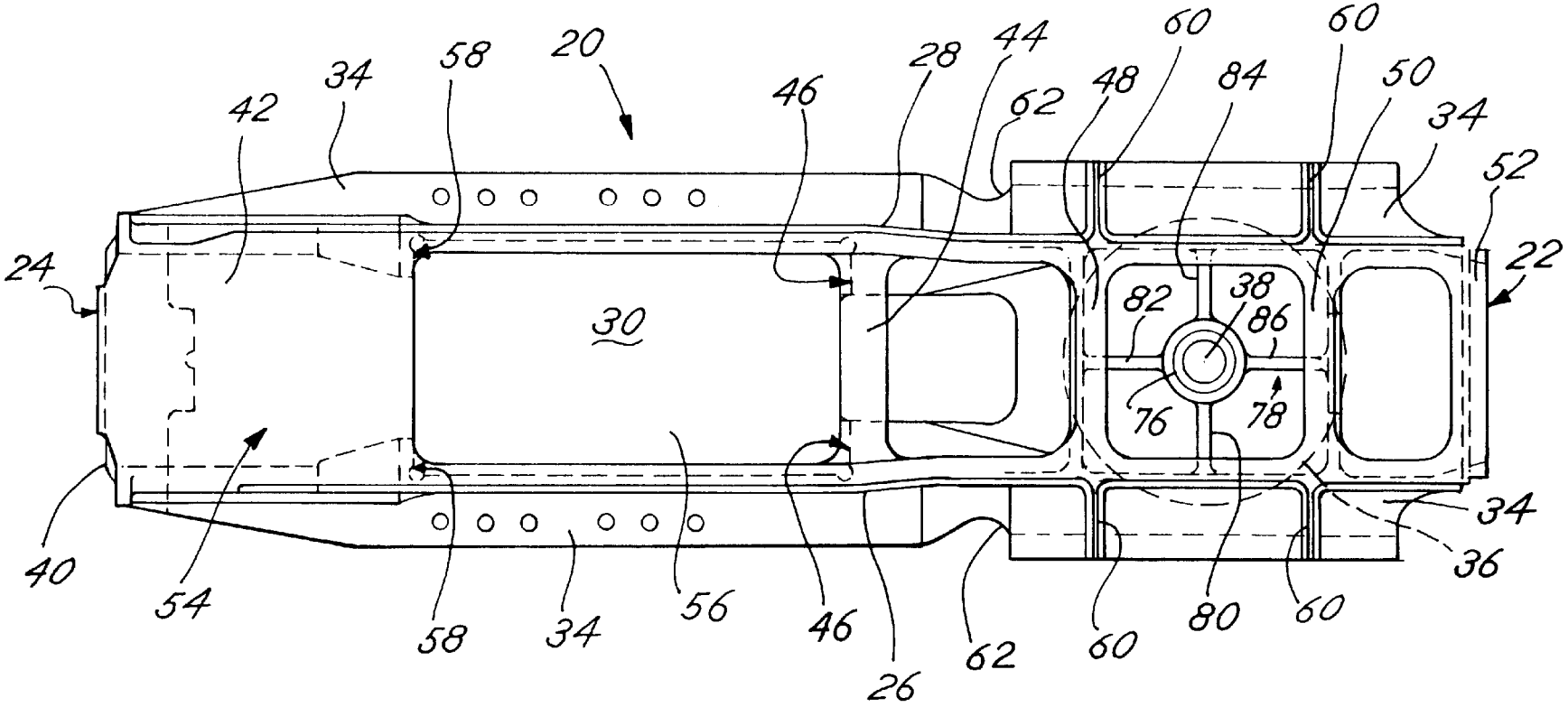
FIG. 1 is a plan view of the draft arm of the present invention.
Figure 2:
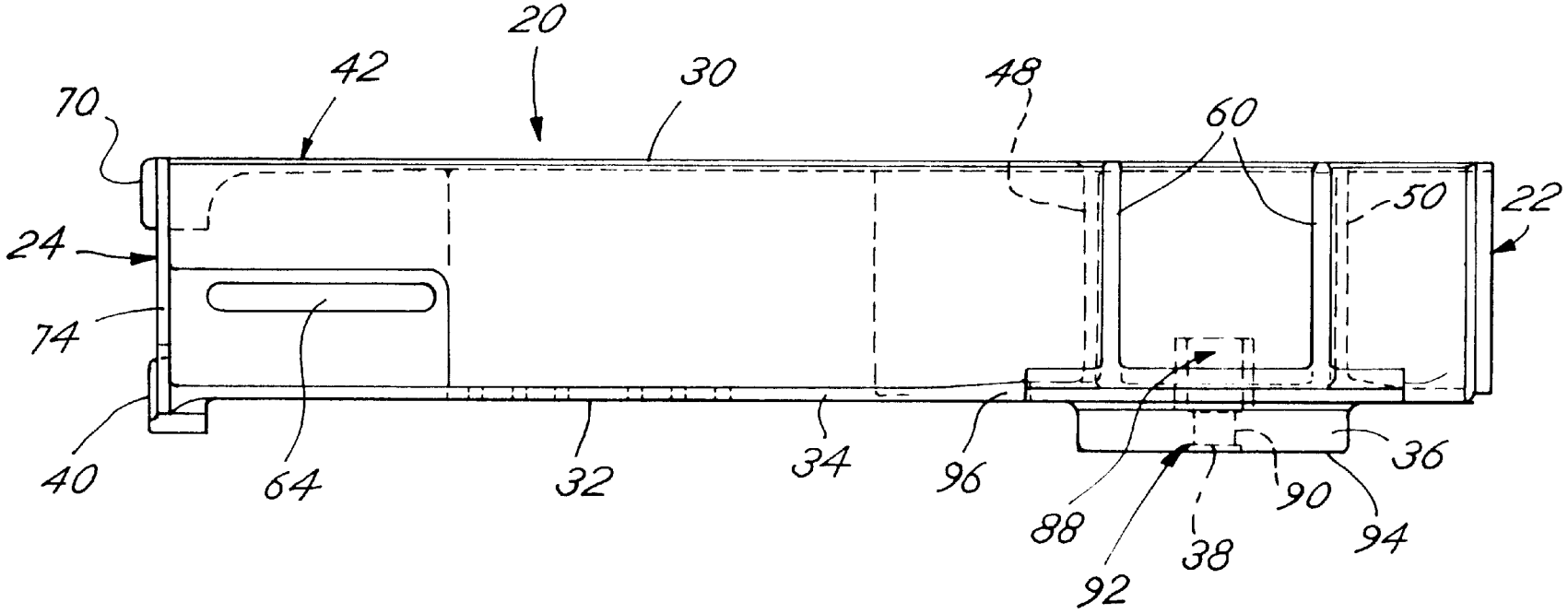
FIG. 2 is a side elevation view of the draft arm of FIG. 1.

Referring to FIG. 1, there is shown a plan view of a draft arm 20 of the present invention. FIG. 2 illustrates the side elevation view of the draft arm 20. The draft arm 20 is cast and customarily made from a high-strength grade B steel. The draft arm 20 generally consists of a vertical open inboard end 22 and a vertical open outboard end 24, a pair of opposing vertical side walls 26 and 28, a horizontal open top surface 30 and a horizontal partially open bottom surface 32. Each of the side walls 26 and 28 terminate, along the bottom surface 32, in a lower outwardly extending flange 34. Near the inboard end 22 along the bottom surface is a center plate 36 having a kingpin hole 38. The kingpin hole 38 is sized and shaped to receive a kingpin, not shown, extending from a railcar truck, not shown, thereby rotatably connecting the draft arm 20 to the truck. The inboard end 22 is fitted within and welded to a center sill, not shown. The outboard end 24 is either fitted with and welded to a striker assembly, not shown, or cast integral with a striker 40. Thus, in operation as mounted and welded to the underframe of a railway car, the draft arm 20 is located between the center sill and the striker and connected to the railcar truck via the kingpin hole.

In a preferred embodiment, a significant portion of the top surface 30 is open, that is, where the top surface is open there is no metal layer. Metal remains for structural purposes on the top surface 30 over the striker area 42, as a tiebar 44 which transverses the side walls 26 and 28 over the rear draft lugs 46, as support members 48 and 50 located on opposite sides of the center plate 36, and as support member 52 located above the vertical open inboard end 22.

Traditionally, the top surface 30 of the draft arm 20 has a metal layer over the entire draft arm 20 and is welded at such surface to the under frame of the railcar body resulting in a double layer of material. In the preferred embodiment, the removal of the top surface layer advantageously eliminates the resulting double layer of material as found in traditional draft arms. Effectively, the underframe of the car body becomes the top layer of the draft arm. Significantly, this elimination of top surface material over traditional draft arms decreases the weight of the draft arm while the tiebar and support members maintain the strength of the draft arm. This decrease in draft arm weight while maintaining constant draft arm strength provides for an increase in the amount of lading carried by railway cars.

In the preferred embodiment, the bottom surface 32 of the draft arm 20 is open having no metal layer in the draft pocket area 54 to install the draft gear, not shown. In addition, an opening 56 through the bottom surface 32 exists between the front draft lugs 58 and the rear draft lugs 46 to install the yoke, not shown. As in traditional draft arms, the remainder of the bottom surface remains closed with a metal layer.

The support members 48, 50 and 52 are cast integral with and perpendicularly transverse the side walls 26 and 28. Support members 48 and 50 extend from the top surface 30 to the bottom surface 32. The tiebar 44 for stabilizing the side walls 26 and 28 during casting is located over the rear draft lugs 46 and along the top surface 30 of the draft arm 20 for added strength in service. The tiebar 44 extends perpendicular from and connects the side walls 26 and 28.

Ribs 60 positioned adjacent the side walls 26 and 28 and formed integral with the associated side walls 26 and 28 serve to reinforce the center plate 36 and provide better lateral load support in the vicinity of the kingpin hole 38. The ribs 60 are located along the exterior of the side walls 26 and 28 and, as exemplified by FIG. 2, extend from the laterally extending flanges 34 to the top surface 30.

The outward extending flanges 34 of the present invention may contain a relief area 62 as illustrated in FIG. 1. In application, this relief area 62 allows the draft arm 20 to attach to a railcar body bolster, not shown. The curved shape of the relief areas help reduce stress concentrations. Note that to alleviate the strength concerns associated with the narrower flange width in the relief area 62, FIG. 2 illustrates the flange 34 thickness has been increased at 96 to maintain the strength of the flange 34.

Figure 3:
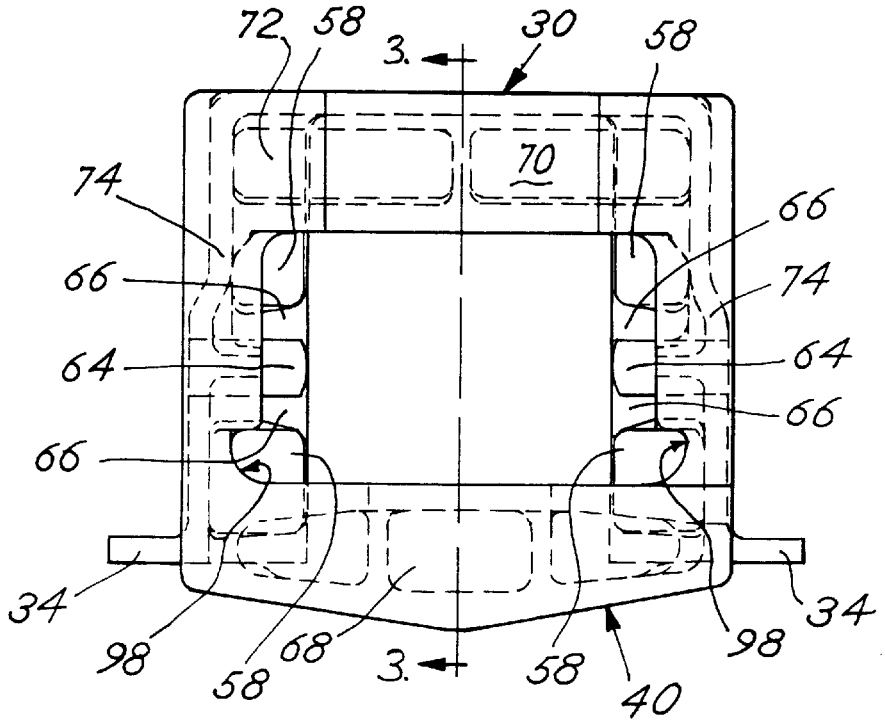
FIG. 3 is an end elevation view of the draft arm of FIG. 2.
Figure 4:
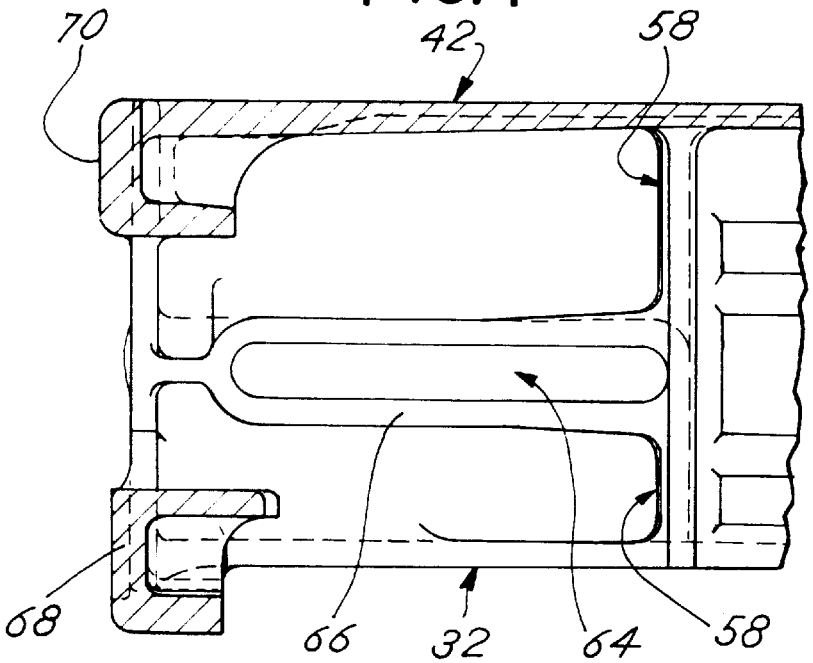
FIG. 4 is a partial cross-section view at line 3—3 of the draft arm of FIG. 3.

Referring to FIGS. 1 and 2, the outboard end 24 of the draft arm 20 comprises the striker area 42. The striker area 42 may include a cast integral striker 40 or a striker assembly that is fitted with and welded to the draft arm 20. The striker 40 receives strikes from the coupler head, not shown, when the railcar goes through severe buff loading, that is, when the draft gear, not shown, is bottomed out or goes through its full travel. Near the outboard end 24 of the draft arm 20 is a pair of aligned draft key slots 64, one in each of the side walls 26 and 28. The draft key slots 64 are horizontally disposed in the side walls 26 and 28 for accommodating a draft key, not shown. Referring to FIG. 4, a draft key slot rib 66 circumscribes the draft key slot 64. The draft key slot rib 66 is formed integral with the interior surface of the associated side wall 26 or 28 and serves to reinforce the striker 40 in the vicinity of the slots 64. Moreover, the draft key slots 64 are sized to cooperate with the key slots of a coupler assembly, not shown, which is mounted within the outboard end 24 of the draft arm 20. Due to drafting restrictions when molding traditional draft arms, the side wall thickness below the keyslot 64 is thicker than required for strength purposes. To eliminate this unneeded material, as illustrated in FIG. 3, the thickness of the side walls 26 and 28 below the key slot 64 is reduced by widening the inside of the draft arm 20, at location 98, between the interior surfaces of the side walls 26 and 28 while maintaining the same distance between the exterior surfaces of the side walls 26 and 28. Unlike traditional draft arms, the side walls 26 and 28 now maintain a relatively constant thickness above and below the key slot 64. Advantageously, this reduction in wall thickness reduces the overall weight of the draft arm while still allowing the draft arm to be pulled from the casting pattern.

The outboard end of the striker 40 is open as shown in FIG. 3 for receiving the coupler assembly. The lower end portions of the side walls 26 and 28 are joined by a horizontal member 68 which serves as a coupler carrier and may be provided with a wear plate adapted to support the coupler assembly. The horizontal member 68 is cast integral with the adjoining side walls 26 and 28. On the outboard end of the striker 40 is a striker face 70 formed integral with the side walls 26 and 28 and a horizontal top wall 72 of the striker 40. The striker face 70 serves as an abutment face when the striker 40 is contacted by the coupler head during severe buff loading. Vertically disposed portions 74 at opposite sides of the opening for the coupler assembly reinforce the side walls 26 and 28 and form an additional abutment surface. Adjacent and above the draft key slots 64 near the inboard end of the slots are the front draft lugs 58. The front draft lugs aid in absorbing the buff loads of the railcars. The front draft lugs 58 are formed integral with the side walls 26 and 28 and extend out from the inner surface of the side walls 26 and 28. The front draft lugs 58 form an abutment face which in operation provide a wall to stop the longitudinal motion of the draft gear, not shown. The draft lugs 58 oppose each other from each side wall 26 and 28 and leave a gap or opening between the lugs 58 to permit the installation of the draft gear.

Referring to FIGS. 1 and 2, the center plate 36 located along the bottom surface 32 of the draft arm 20 comprises a centrally positioned internal kingpin post 76 which defines the vertical kingpin hole 38. The kingpin post 76 is connected to a web 78 comprising a plurality of laterally-extending, vertically-oriented ribs 80, 82, 84, and 86 which provide longitudinal and lateral support for the kingpin post. At one end, each rib integrally connects with the kingpin post 76. At the opposite end, ribs 80 and 84 integrally connect with the side walls 26 and 28, and ribs 82 and 86 integrally connect with the support members 48 and 50. The support members 48 and 50 not only provide lateral support for the draft arm 20 between the side walls 26 and 28 but also longitudinal support for the kingpin post 76 and accompanying kingpin hole 38.

Referring to FIG. 2, the kingpin hole 38 includes an upper cylindrical section 88 centrally positioned with the kingpin post 76. The kingpin hole 38 further includes a middle cylindrical section 90 coaxially positioned with and of slightly smaller diameter than the upper cylindrical section 88. The kingpin hole 38 still further includes a bottom cylindrical section 92 coaxially positioned with and of slightly greater diameter than the middle cylindrical section 88. The bottom cylindrical section 92 of the kingpin hole 38 extends to the center plate surface 94.

As illustrated in FIG. 2, the center plate 36 is integral with the draft arm 20 along the bottom surface 32 and protrudes out from the horizontal bottom surface 32 and terminates to form the center plate surface 94 that is in parallel relation to the horizontal bottom surface 32. Note that in consonant with the spirit and scope of the present invention, the center plate 36 may be an independent plate that is welded to the bottom surface 32 of the draft arm 20.

The rear draft lugs 46 are cast integral with the draft arm 20 and are formed out of the interior surface of the side walls 26 and 28 and extend laterally along the bottom surface away from the interior surface of the side walls 26 and 28 toward the longitudinal axis of the draft arm 20. The rear draft lugs 46 form an abutment surface which in operation provide a wall to stop the longitudinal motion of the yoke. The rear draft lugs 46 oppose each other from each side wall 26 and 28 and leave a gap or opening between the lugs to permit the installation of the yoke.

The preferred embodiments of the invention are now described as to enable a person of ordinary skill in the art to make and use the same. Variations of the preferred embodiment are possible without being outside the scope of the present invention. Therefore, to particularly point out and distinctly claim the subject matter regarded as the invention, the following claims conclude the specification.

What is claimed is:

1. A cast draft arm of relatively light weight construction for a railway car to be located between a center sill and a striker in longitudinal alignment therewith comprising:

a pair of vertical side walls terminating into a pair of lower outwardly extending flanges, a horizontal open top surface perpendicular to the plane formed by the pair of vertical side walls, the cast draft arm defining a draft pocket area, the horizontal top surface being open over the draft pocket area, a tiebar transversing the pair of vertical side walls in close proximity to the horizontal open top surface, and a horizontal bottom surface.

2. The cast draft arm as in claim 1 further comprising at least one support member transversing the pair of vertical side walls.

3. The cast draft arm as in claim 1 wherein the horizontal bottom surface is partially open.

4. A cast draft arm of relatively light weight construction for a railway car to be located between a center sill and a striker in longitudinal alignment therewith comprising:

a pair of vertical side walls terminating into a pair of lower outwardly extending flanges, a horizontal open top surface perpendicular to the plane formed by the pair of vertical side walls, the cast draft arm defining a center plate pocket area, the top surface being open over the center plate pocket area, a tiebar transversing the pair of vertical side walls in close proximity to the horizontal open top surface, at least one support member transversing the pair of vertical side walls in close proximity to the horizontal open top surface, and a horizontal partially open bottom surface.

5. A cast draft arm of relatively light weight construction for a railway car to be located between a center sill and a striker in longitudinal alignment therewith, the cast draft arm comprising:

a pair of vertical side walls terminating into a pair of lower outwardly extending flanges, a horizontal open top surface perpendicular to the plane formed by the pair of vertical side walls, a plurality of vertical support ribs located external to the vertical side walls and extending from the lower outwardly extending flanges toward the horizontal open top surface, a tiebar transversing the pair of vertical side walls in close proximity to the horizontal open top surface, at least one support member transversing the pair of vertical side walls in close proximity to the horizontal open top surface, and a horizontal partially open bottom surface.

6. The cast draft arm of claim 5 wherein the draft arm defines a draft pocket area, the horizontal top surface being open over the draft pocket area.

7. The cast draft arm of claim 5 wherein the draft arm defines a center plate pocket area, the horizontal top surface being open over the center plate pocket area.

* * * * *